US007819207B2

(12) United States Patent
Cowan

(10) Patent No.: US 7,819,207 B2
(45) Date of Patent: Oct. 26, 2010

(54) MOBILE LAND DRILLING RIG AND METHOD OF INSTALLATION

(75) Inventor: Mike D. Cowan, Odessa, TX (US)

(73) Assignee: MD Cowan, Inc., Odessa, TX (US)

( * ) Notice: Subject to any disclaimer, the term of this patent is extended or adjusted under 35 U.S.C. 154(b) by 0 days.

(21) Appl. No.: 12/211,208

(22) Filed: Sep. 16, 2008

(65) Prior Publication Data

US 2009/0071720 A1 Mar. 19, 2009

Related U.S. Application Data

(60) Provisional application No. 60/973,611, filed on Sep. 19, 2007.

(51) Int. Cl.
*E21B 19/00* (2006.01)

(52) U.S. Cl. ..... 175/52; 175/85

(58) Field of Classification Search ..... 175/24–27, 175/28, 57, 162, 52, 85; 166/77.1; 414/23
See application file for complete search history.

(56) References Cited

U.S. PATENT DOCUMENTS

| | | | | |
|---|---|---|---|---|
| 3,112,830 | A * | 12/1963 | Podlesak | 414/23 |
| 3,922,825 | A | 12/1975 | Eddy et al. | 52/116 |
| 3,942,593 | A * | 3/1976 | Reeve et al. | 173/186 |
| 4,269,395 | A | 5/1981 | Newman et al. | 254/386 |
| 4,290,495 | A | 9/1981 | Elliston | 175/85 |
| 4,336,840 | A * | 6/1982 | Bailey | 166/77.4 |
| 4,368,602 | A | 1/1983 | Manten | 52/115 |
| 4,821,816 | A | 4/1989 | Willis | 175/57 |
| 4,899,832 | A | 2/1990 | Bierscheid, Jr. | 173/23 |
| 6,634,436 | B1 | 10/2003 | Desai | 173/1 |
| 6,860,337 | B1 | 3/2005 | Orr et al. | 173/28 |
| 6,913,097 | B1 | 7/2005 | Orr et al. | 175/162 |
| 6,951,082 | B2 | 10/2005 | Nelson et al. | 52/112 |
| 7,228,919 | B2 * | 6/2007 | Fehres et al. | 175/85 |
| 7,320,374 | B2 * | 1/2008 | Folk et al. | 175/220 |
| 2002/0046531 | A1 | 4/2002 | Bockhorn et al. | 52/651.01 |
| 2003/0172599 | A1 | 9/2003 | Frink | 52/116 |
| 2005/0194189 | A1 * | 9/2005 | Barnes | 175/122 |
| 2007/0017704 | A1 * | 1/2007 | Belik | 175/52 |
| 2008/0149395 | A1 * | 6/2008 | Fossbakken et al. | 175/162 |

OTHER PUBLICATIONS

National Oilwell Varco webpages 1-4; "Rapid Rig"; www.nov.com; copyright 2006.

* cited by examiner

*Primary Examiner*—David J Bagnell
*Assistant Examiner*—Yong-Suk Ro
(74) *Attorney, Agent, or Firm*—Charles D. Gunter, Jr.; Stephen S. Mosher

(57) ABSTRACT

A mobile oil, gas and geothermal well drilling rig provides for the rapid placement, assembly, disassembly, and repositioning of various rig components of the drilling rig. The drilling rig includes a support base and working floor which is trailerable and which can be rapidly erected to a working height at the well site. A drawworks trailer transports both the drawworks and the rig derrick. Hydraulic cylinders on the drawworks trailer are used to move the derrick from a horizontal, transport position to a vertical, working position while the weight of the derrick is off-loaded from the drawworks trailer to the base support structure.

4 Claims, 15 Drawing Sheets

MOBILE LAND DRILLING RIG AND METHOD OF INSTALLATION

CROSS-REFERENCE TO RELATED APPLICATION

The present application claims priority from earlier filed provisional application Ser. No. 60/973,611, filed Sep. 19, 2007, entitled "Mobile Land Drilling Rig and Method of Installation by the same inventor.

BACKGROUND OF THE INVENTION

1. Field of the Invention

The present invention relates generally to oil, gas and geothermal well drilling rigs and, more specifically, to a mobile well drilling rig and to the transport, assembly, and disassembly of such a rig.

2. Description of the Prior Art

With the ever increasing pressure in recent years on domestic oil and gas production, it has become increasingly important to provide mobile drilling rigs which can be easily transported over the highway and which can be rapidly assembled and disassembled at the well site. For example, present well exploration and completion in the Barnett Shale region in Texas has expanded even into urban areas. In these and other settings, to be economically competitive, oil and gas drilling and exploration activities require the rapid deployment, assembly and disassembly of drilling structures. One way to accomplish these goals is to provide a mobile, highly capable rig which maximizes productive on-site drilling time in urban or rural settings, while minimizing essentially non-productive erection, disassembly and road transportation time. As a result, the transportability of components and the speed at which components can be assembled with the minimum amount of auxiliary equipment becomes a paramount concern.

A transportable drilling rig typically includes, for example, a support base, a derrick, pipe sections, and a drill floor Often times however, auxiliary support equipment such as cranes are required to facilitate the setup and takedown of large components such as the base, the drill floor, the pipe racking board, and the like, having the effect of increasing operational costs. Further, drilling sites are often located in remote areas requiring truck transportation of the components of the rig accompanied by equipment used to assemble the rig. In some cases, the process is further complicated by the need to change locations once a hole is drilled and it is determined whether the site will be sufficiently productive to merit a pumping installation, whether the site will be unproductive all together, or whether a more ideal location exists to drill a hole. Typically, site changes can occur once every several months, and, in response, prior art systems have attempted to increase the degree of mobility of rig components. Auxiliary equipment however is still necessary for performing many of the steps involved in assembly and disassembly of the rig.

Since the variable costs associated with leased support equipment, such as cranes and the like, are calculated on a per hour or per day basis, expediting the takedown, transport, and setup operations is crucial for minimizing equipment leasing costs. Typical takedown and setup time is on the order of days. With equipment leasing costs ranging from several hundred dollars per day or more, many thousands of dollars in costs may be incurred for each end of a setup and takedown operation. For larger or more complex rigs, the cost may be even higher. Even where the prior art drilling rigs are geared towards facilitating rapid setup, takedown and transport, they have still generally required external cranes, external winches, and the like which increase the overall expense.

A number of factors contributed to the takedown and setup time required by the prior art systems. For example, in the past, disassembly of the drilling rig mast assemblies normally required unstringing and removal of the traveling block cables and traveling block prior to lowering the mast from the drill rig or at least prior to disassembly or telescoping of the mast preparatory to moving on to a new well site. Also, erection of the mast assemblies of the prior art mobile drilling rigs tended to delay start-up of drilling operations since the drill-pipe cannot be moved into a suitable ground position for racking until such time as the mast is raised to the vertical and the pipe racking ground area is cleared. Further, the access road to a drilling rig normally courses directly up to the drawworks side of the rig. Where the intended well site is located on marshy ground, it is normally necessary to expend substantial time and effort in grading and stabilizing a substantial ground area completely around the rig in order to provide access and working area for the necessarily heavy equipment required to move and erect the mast. These are merely intended to be exemplary problems of the type encountered by the prior art, as there were numerous other problems associated with assembly and disassembly of drilling rigs of the type under consideration.

Although a number of prior art references exist which show purported "portable" or mobile drilling rigs, such devices tended to suffer from one or more deficiencies. One such prior art system for erecting an oil well derrick is shown in U.S. Pat. No. 3,922,825, to Eddy's et al, issued on Dec. 2, 1975. Eddy's system employs a stationary substructure base with a companion movable substructure base mounted thereon. Eddy's movable substructure base is coupled to the stationary base but swings upright into an elevated position on a series of struts that are connected to the stationary base. Eddy's movable base is otherwise stationary, since neither the stationary base nor the "movable" base are mobile or repositionable without the use of an auxiliary crane. Also, simply raising the movable substructure base and the drill mast requires the use of a winch mounted on an auxiliary winch truck.

Another prior art system for assembly of a drill rig is shown in U.S. Pat. No. 3,942,593, to Reeve, Jr., et al, issued on Mar. 9, 1976. The Reeve apparatus includes a trailerable telescoping mast and a separate sectionable substructure assembly further comprising a rig base, a working floor, and a rail means. The mast is conveyed to the top of the substructure by rollers and may be raised by hydraulic raising means to the upright position. A disadvantage of the Reeve system is the need for drawlines and a winch to raise the mast onto the working floor.

U.S. Pat. No. 4,269,395, to Newman et al., issued May 26, 1981, shows a portable rig which includes a telescoping mast for telescoping to a reduced length for transport. The mast is also cantilevered in use so that the traveling block moves vertically at one side of the mast.

U.S. Pat. No. 4,290,495, to Elliston, issued Sep. 22, 1981, shows a portable workover rig with a base platform and a collapsible mast which is movable from a reclining position during transport to an erect position in operation.

U.S. Pat. No. 4,821,816, to Willis, issued Apr. 18, 1989, shows an "Apache" modular drilling machine. The machine has a substructure skid and a platform which supports a draw works. A pipe boom is mounted on another skid and is designed to fit between skid runners on the drilling substructure skid. The drilling substructure skid supports four legs which are pivotally mounted at the platform and at the substructure. A pair of platform cylinders are provided to raise and lower the drilling platform.

U.S. Pat. No. 4,899,832, to Biersheid, issued Feb. 13, 1990, shows a modular drilling apparatus that is transported in modular units to the well site. The apparatus includes a drilling unit and two raising units that are locked to the respective opposite sides of the drilling unit. After base structures on the raising units are lowered to the ground to provide a support, the towers of the raising units and the mast of the drilling unit are simultaneously elevated to the vertical.

U.S. Pat. No. 6,634,436, to Desai, issued Oct. 21, 2003, shows a mobile land drilling rig with a mobile telescoping substructure box which assists in the rapid placement, assembly, disassembly and repositioning of the drilling rig and associated drilling equipment.

U.S. Pat. No. 6,860,337, to Orr et al., issued Mar. 1, 2005, describes a process for lowering or raising a drilling rig for transportation. The top drive is moved within the mast with a vertical guide and torque reaction mechanism to a locked position prior to transport.

As has been mentioned, a number of the devices shown in the above described prior art require the need for auxiliary equipment such as cranes, winch trucks and the like to erect the derrick. Several of the systems described above require a large substructure that must be set down with a crane prior to the imposition of any additional structure thereupon. Further movement or repositioning of the base structure requires cranes or other heavy equipment to effect movement of the component parts.

It is therefore an object of the present invention to provide a mobile land rig that is self sufficient and thus capable of being transported, erected, and disassembled without the need for extensive auxiliary equipment such as cranes and winch trucks. Such a system would save costs associated with leasing cranes and the like for periods of days during erection and disassembly of rigs.

Another object of the invention is to provide a drilling rig system with a self contained substructure base capable of being easily moved. Such a system would allow rapid placement and repositioning of the substructure base without the need for a crane or the like.

Another object of the invention is to provide such a drilling system wherein all system components are easily trailerable and transportable by truck. Such a system could be easily moved from one site to another with a minimum of setup and takedown time.

The above needs and objectives are met in the invention as described in the discussion which follows.

SUMMARY OF THE INVENTION

It is accordingly a principal object of the present invention to provide an improved mobile drill rig assembly having advantages over the prior art systems described above.

It is another object of the invention to provide a mobile drill rig assembly which is rapidly erected and dismantled at the well site.

It is yet another object of the invention to provide a drill rig assembly having good wind stability.

It is another object of the invention to provide a drill rig assembly including a support base and working floor which is trailerable and which can be rapidly erected to a working height at the well site.

It is another object of the invention to provide a one piece derrick mast assembly which is itself a trailerable component of the system.

The drilling rig of the invention is adapted for use in oil, gas and geothermal exploration and drilling operations. In particular, the present invention is a mobile land rig and method for the rapid placement, assembly, disassembly, and repositioning of such an oil and gas drilling rig and associated drilling equipment. The rig includes a variety of drilling rig components including at least a base support structure, a drawworks trailer, a one-piece derrick initially carried on the drawworks trailer, a pipe handler, a mud delivery system and a power package.

Preferably, the drawworks trailer has at least a rear axle coupled thereto, the axle having at least one set of wheels for supporting both drawworks and the derrick in rolling relation to a ground surface when the derrick is in a horizontal, transport position on the drawworks trailer. A pair of oppositely arranged hydraulic piston-cylinders are located on either of two sides of the drawworks trailer, the cylinders being pivotally connected at one end to the trailer and at an opposite end to the rig derrick, whereby activating the piston-cylinders between a retracted position and an extended position causes the derrick to move between the horizontal, transport position and a vertical, working position. Movement of the derrick from the horizontal, transport position to the vertical, working position serves to off-loading the derrick from the drawworks trailer to the base support structure.

The pipe handler which is used with the mobile land rig of the invention includes a Y-shaped yoke element with gripping jaws located at either of two opposite extents thereof, the yoke element being positionable between a horizontal pipe receiving position and a vertical pipe delivery position. The pipe handler jaws are sized to handle pipe up to 13⅝ inches in diameter.

The mobile rig of the invention also preferably includes a stationary ramp having an inclined, upper ramp surface, the ramp being delivered to the drilling site on ground engaging wheels. Driving the drawworks trailer up the inclined surface of the stationary ramp serves to raise one end thereof with respect to an opposite end of the trailer. The opposite end of the trailer is equipped with a hydraulic piston-cylinder for thereafter raising the rear end of the trailer hydraulically so that the derrick forms a horizontal plane with respect to the ground prior to the erection of the derrick.

The derrick is adapted to receive a top drive drilling apparatus.

The mud delivery system of the mobile rig of the invention includes at least one mud process tank having a curved tank bottom.

The rig components also preferably include both a bottom dog house and a top dog house. The top dog house is preferably equipped with at least one hydraulic piston-cylinder for hydraulically raising the dog house and at least one hydraulic piston cylinder to pin and secure the top dog house once raised.

The improved method for erecting, transporting, and disassembling a drilling rig on the ground from variety of rig components includes, as a first step, rolling the drilling rig components into proximity with a drilling site on ground engaging wheels, where the drilling rig components include at least a base support structure, a drawworks trailer, a one-piece derrick initially carried on the drawworks trailer, a pipe handler, a mud delivery system and a power package. The one-piece derrick is raised from a horizontal, transport position to a vertical, working position while off-loading the derrick from the drawworks trailer to the base support structure. In the preferred method of assembly and disassembly of the invention, the drilling rig components are delivered and assembled without the use of cranes.

Additional objects, features and advantages will be apparent in the written description which follows.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
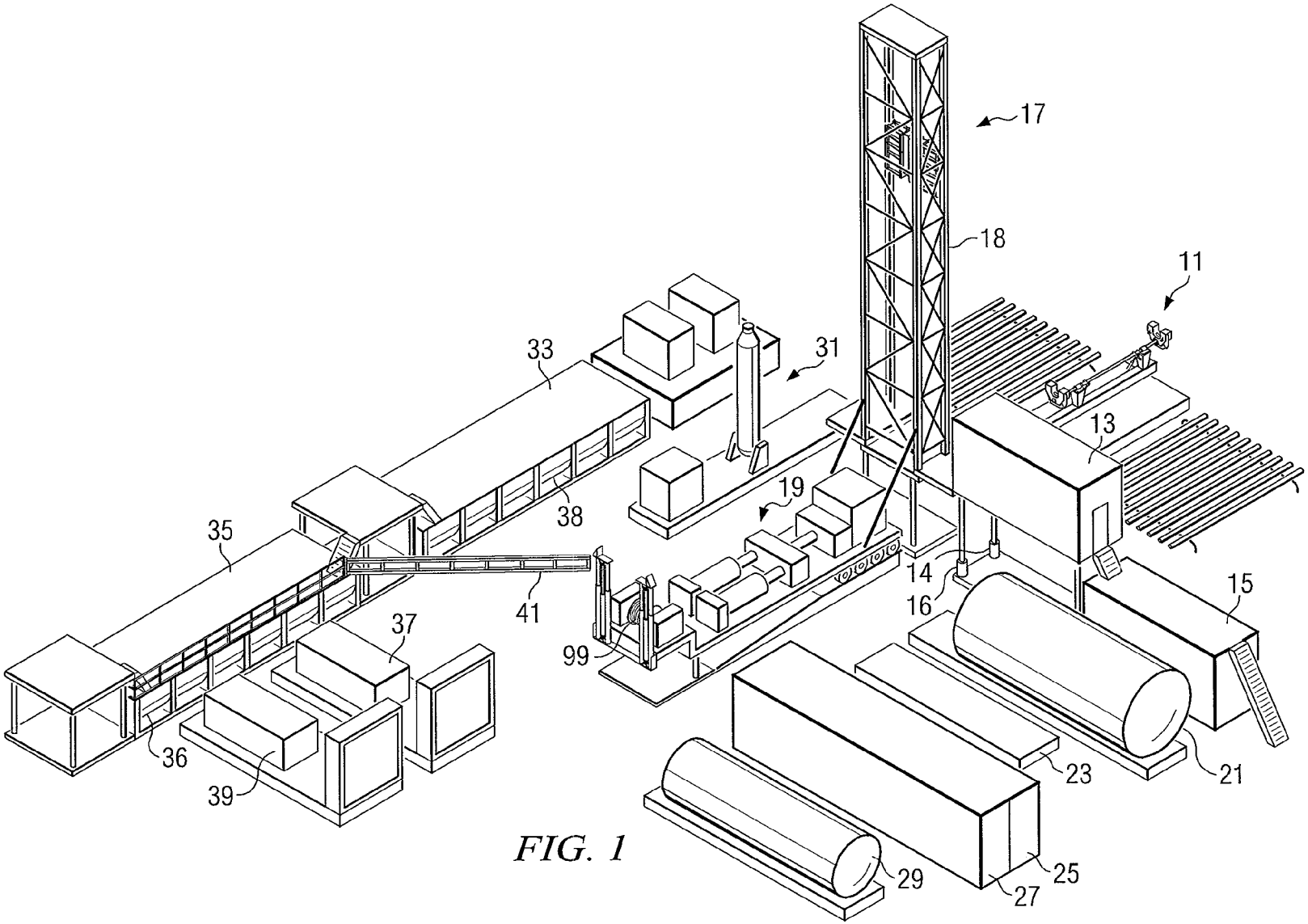
FIG. 1 is a plan view of the assembled drilling rig of the invention showing the various components thereof.

Turning to FIG. 1 of the drawings, there is shown a highly mobile and capable drilling rig that can be assembled and disassembled in record time as compared to the devices of the prior art. In one exemplary form, the total rig transports in just 16 trailer loads, saving time and money. The loads are compact and self-contained. Rig-up is faster than in the prior art and is hydraulically powered. The entire rig is designed to be moved without the use of cranes.

The mobile drilling rig of the invention is designed to streamline drilling operations with fast moves and more efficient drilling operations. The rig can be used over a broad depth range, i.e., on the order of 6,000 to 12,000 feet. The rig footprint is smaller, which means lower construction costs and less environmental impact or the necessity of extensive site preparation. The pipe handling system is mechanized and safer for rig crews to use, allowing a single operator to make a connection, if necessary.

The assembled rig, as shown in FIG. 1, includes a horizontal pipe handler (shown in simplified fashion as 11 in FIGS. 1, 11, 15 and 16) located adjacent an upper dog house 13 and a lower dog house 15. Once delivered on site, the upper dog house 13 is raised to a desired height by means of hydraulic cylinder legs 14, 16. The pipe handler 11 sits in front of the derrick 17 and the draw works trailer 19. The pipe handling system includes a hydraulically powered, remotely operated pipe boom (best seen as 47 in FIG. 2). A pair of spaced jaws 49, 51 receive a stand of horizontally stored pipe (53 in FIG. 16). The boom then pivots at the yoke end (55 in FIG. 16) between the rest position shown in FIGS. 2 and 16 and a vertical position (not shown) aligned with the derrick for making a pipe connection and inserting the joint of pipe into the string of drill pipe extending into the well bore. The pipe boom can handle tubulars from 2⅞ inches to 13⅝ inches in diameter.

Figure 2:
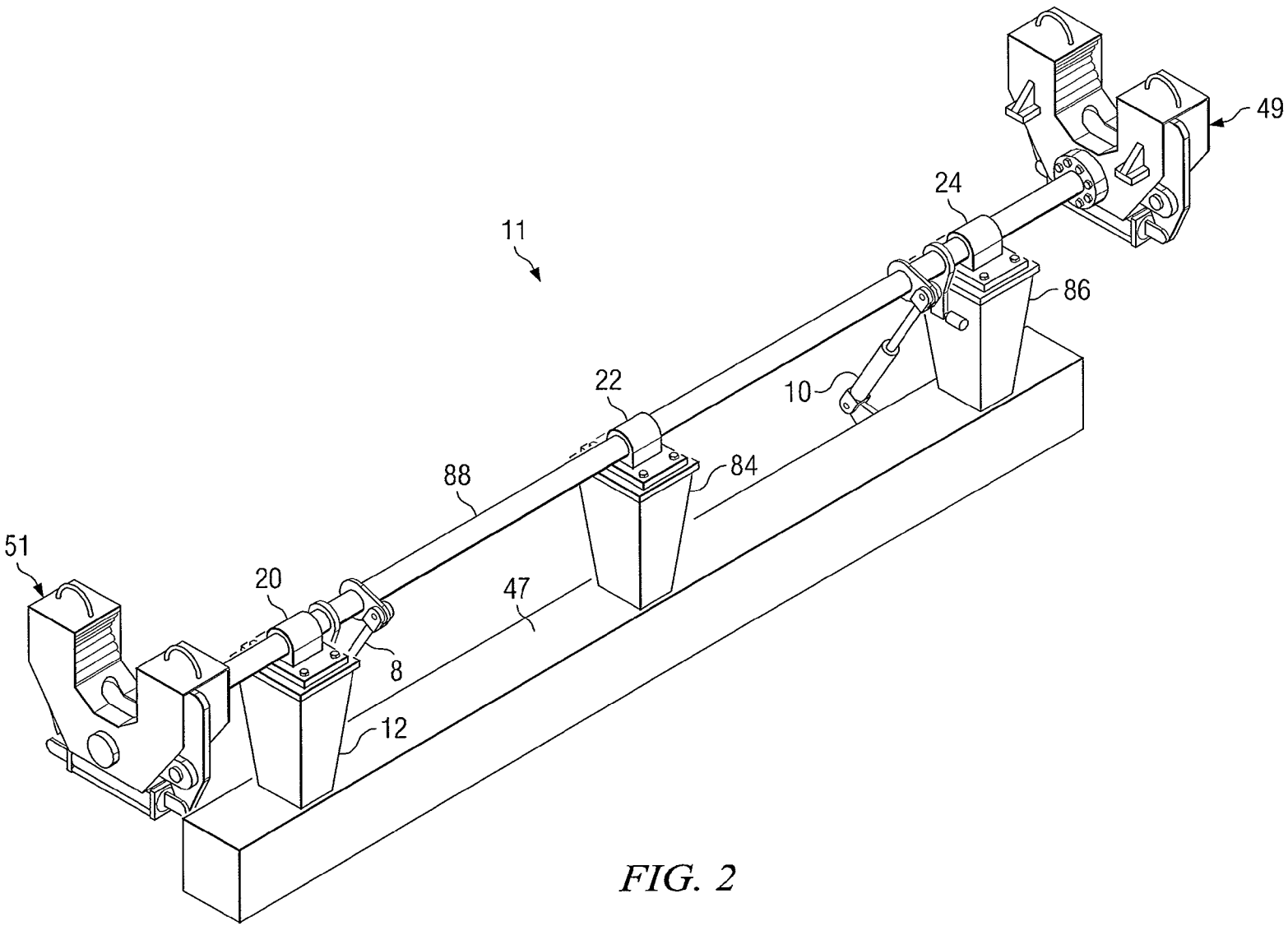
FIG. 2 is an isolated, perspective view of the pipe handler component of the drilling rig of the invention.

As will be appreciated from FIG. 2, the pipe boom 47 of the pipe handler has a series of upright pillars 12, 14 and 16, each of which forms a primary structural support for the pivoting tubular section 18. The tubular section 18 is pivoted in a horizontal plane as viewed in FIG. 2 by means of the hydraulic cylinders 8, 10. The pivoting action orients the gripping jaws 49, 51 for gripping a stand of pipe located in the horizontal pipe racks (53 in FIG. 16). Each of the upright pillars 12, 14 and 16 has an engagement collar (20, 22, 24 in FIG. 2) which can be bolted and unbolted from the top surface of the respective pillar. In this way, the entire pivoting tubular section 18 with its gripping jaws 49, 51 can be removed and switched out with, for example, a boom having gripping, jaws of a different size range for handling a different size of pipe.

Returning to FIG. 1, immediately behind the dog houses are located a water tank 21, a lubrication skid 23, a hydraulics package 25, a power unit generator package 27, and a fuel tank 29. The tankage provided on site in the form of the water tank 21 and fuel tank 29 comprises, for example, a 285 barrel cylindrical water tank capacity and a 500 barrel cylindrical diesel fuel tank, respectively. The power system can be, for example, a CAT C-15; CAT 455 KW (two each) generators capable of providing continuous output. This diesel engine/generator can individually produce 540 hp of maximum continuous power at a rotation speed of 1200 rpm. The output voltage of the AC generator is 60 Hz, 480 volts.

Figure 4:
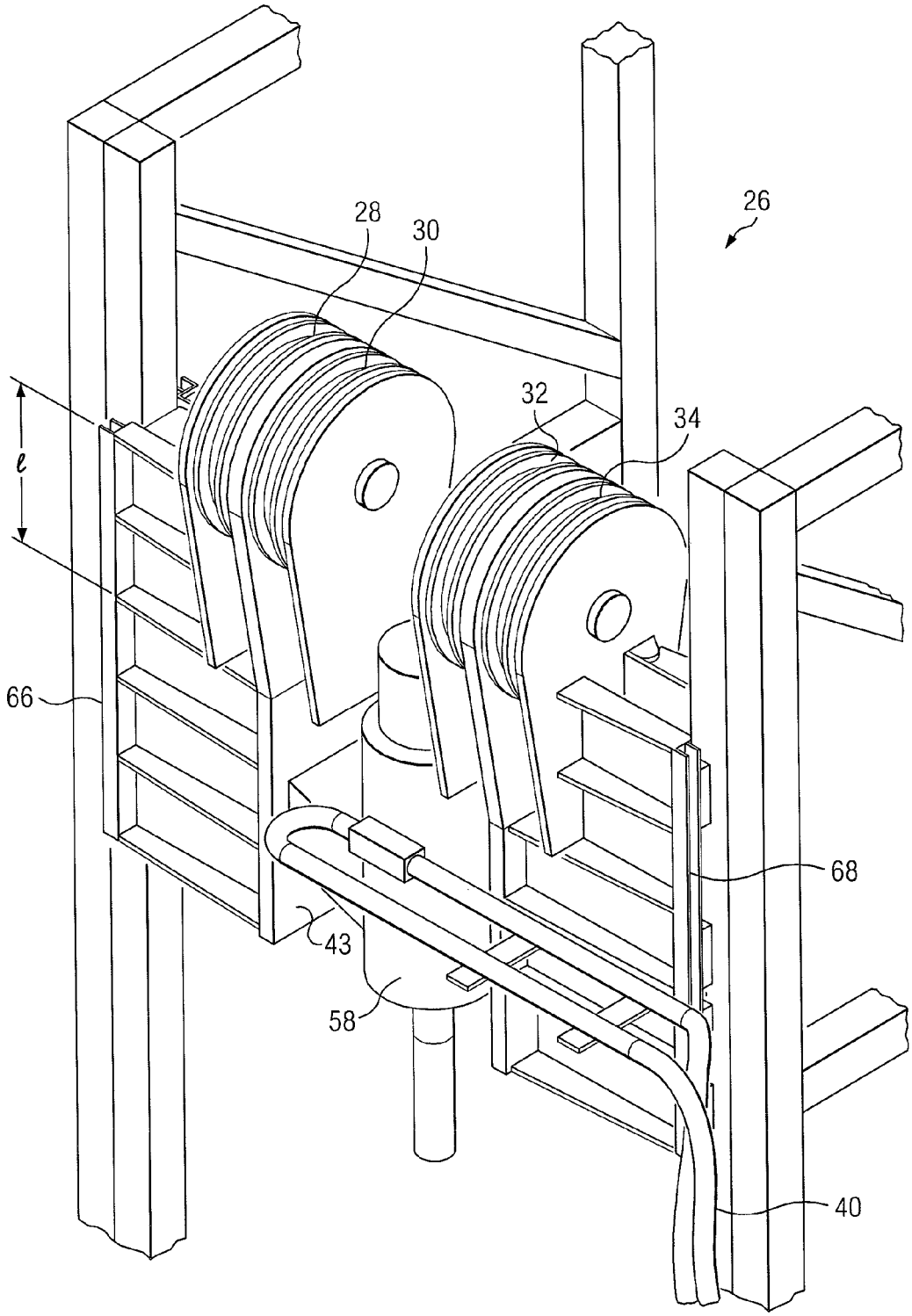
FIG. 4 is a view of a portion of the mast of the drilling rig of FIG. 1 showing the integrated top drive, traveling block and components thereof.

In the particular version of the invention illustrated in simplified version in FIG. 1, the derrick 17 is a one piece mast with integrated top drive (shown in greater detail as 26 in FIG. 4 including traveling block 43 and top drive 58). The mast is a single piece 72 foot structure using a split block hoisting on a 1⅛" drill line. The wire line unit can be, for example, an Oil Works OWI-1000™ holding 12,000' of 0.092 to 0.108 inch wire. The crown block is an IDS model having a rated capacity of 500,000 SHL. There are 7 vertical sheaves and 1 horizontal sheave. The sheaves in the crown/traveling block have been upgraded from 24 inches to 30 inches. The traveling block assembly 86 is a Cowan Integrated 4-Sheave Split Block™ having a rated capacity of 250 tons. There are 4 sheaves of 30" diameter, labeled as 28, 30, 32, 24 in FIG. 4. The derrick has a set of C-shaped front rails (18A in FIG. 1 and *Fig*. 16) to accommodate the travel of the top drive 58. The top drive 58 can be, for example, a Venture Tech XK-250™ 250 ton drive providing a maximum torque of 24,000 ft/lbs at a maximum speed of 160 RPM. The top drive has a 5,000 psi pressure rating. The dimensions of the exemplary derrick base and crown illustrated are 8'1" wide×6' deep.

As can be best seen in FIG. 4, the 4 sheave traveling block 43 and top drive 58 (assembly 26) have oppositely arranged "bat wings" 66, 68 which engage the C-shaped rails of the derrick structure and allow the top drive unit to move vertically along the mast. In earlier versions of the drilling rig, the utility lines 40 which extend downwardly from the top drive were found to create an undue load off one side of the mast which affected the travel of the top drive along the mast. As a result, the top portion of the bat wings have now been extended in length from the original three and one half feet to five and one half feet, the extended portion being designated as "1" in FIG. 4. The extended length of the bat wing improves the load distribution and provides added stability for the top drive as it moves along the derrick mast legs.

Figure 3:
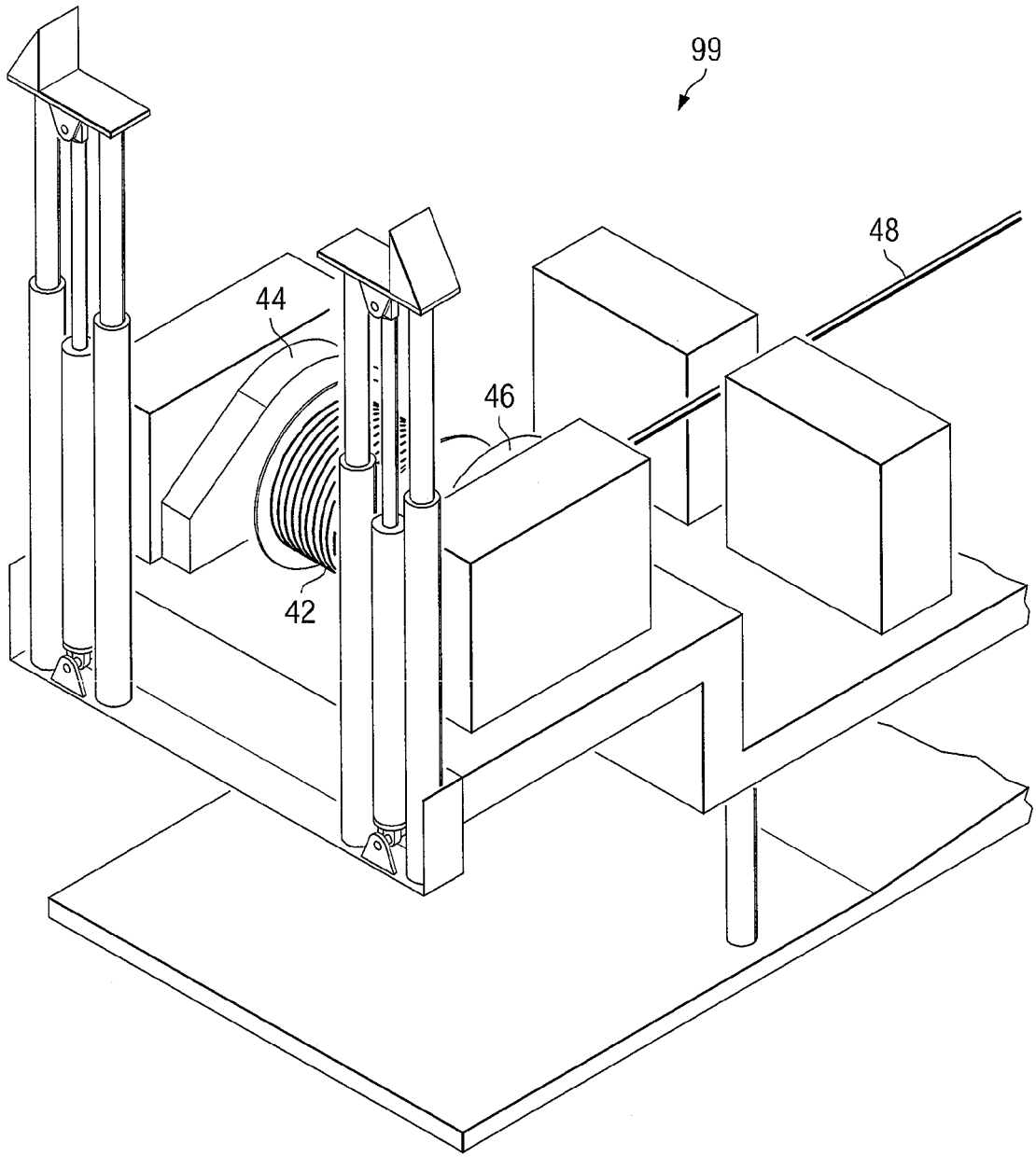
FIG. 3 is a simplified view of a portion of the draw works trailer of the drilling rig of FIG. 1 showing the drill line spool on the opposite end of the trailer from the draw works.

The rig drawworks (99 in FIG. 1) is comprised of a Rig Tech RT-400B™ powered by a CAT C-15 engine with a rated input power of 540 hp. The drawworks is shown in greater detail in FIG. 3. The drawworks drum 42 is a 18"×25⅛" diameter grooved drum supported between bearing assemblies 44, 46, and is provided with a disk drum style brake system which provides an auto spool safety feature. The spool arrangement also allows the operator to move the wear points in the drill line 48 by slipping and cutting, e.g., 70-100 feet of line between drilling sessions. The maximum hook load of the assembly with 8 lines is 435,000 lbs. An independent fresh water cooling system is provided for the drawworks and clutch brake, such as the Eaton-Airflex Model RT-BWCS-101™.

At the derrick base there will be located a conventional make-up/break-out tool (not shown) such as the Gray EOT Floor Hand™, providing up to 80,000 ft/lbs of torque for making and breaking drill pipe connections as well as rig floor pneumatic air slips. The rotary opening of the derrick substructure is approximately 14'8" above ground level in the exemplary illustrations. The slip bowl capacity is 250 tons with a clearance height below the slip bowl to ground level of 10'6".

The additional rig components located in the foreground include a trip tank/choke skid 31, a mud process skid 33 and a mud mixing skid 35. The trip tank/choke skid 31 houses a trip tank, choke manifold and mud-gas separator. Mud pump skids 37 and 39 are located adjacent the mud mixing skid 35 A utility swing arm 41 pivots from a support point on the mud process and mixing skid.

Figure 5:
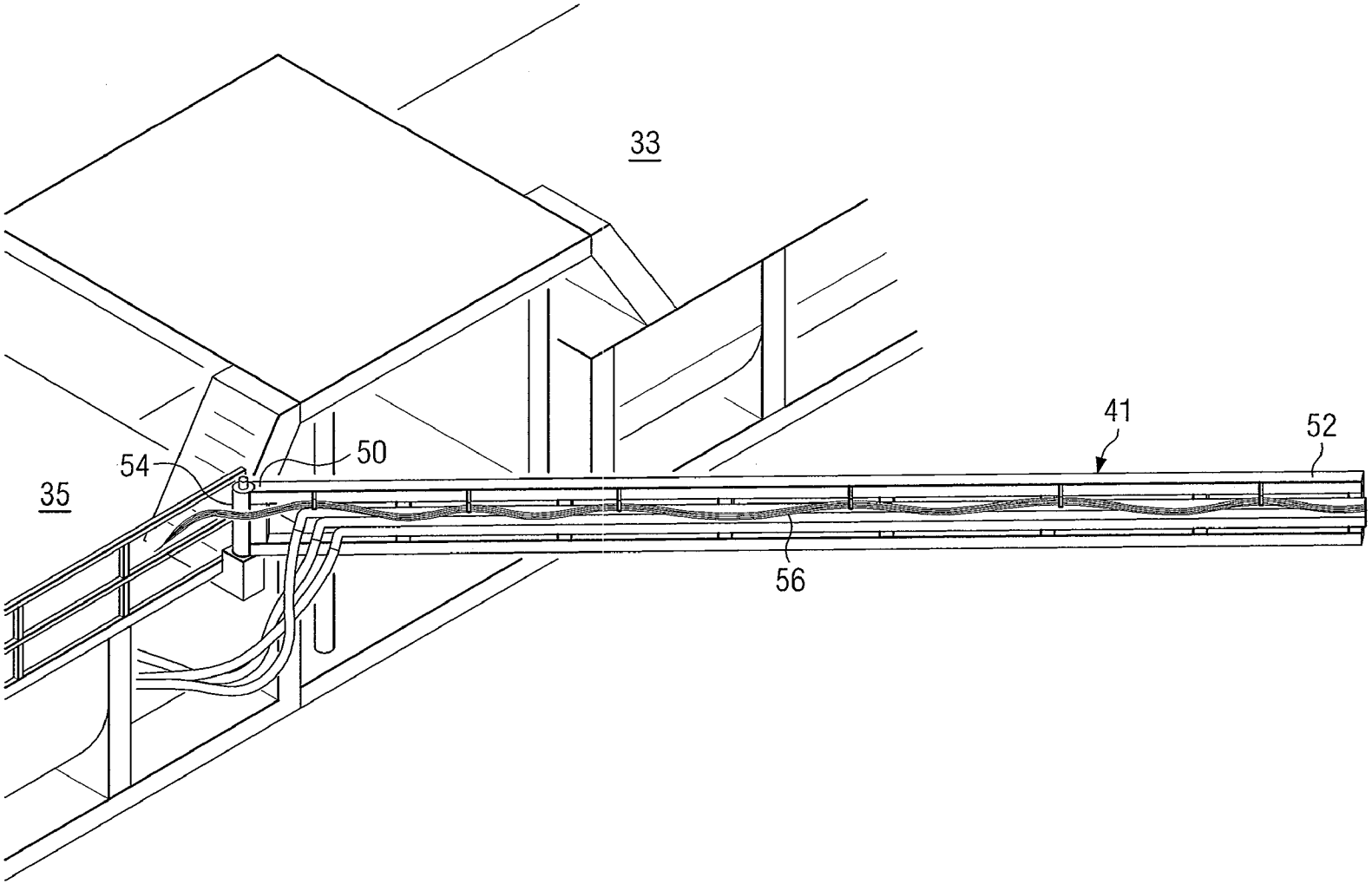
FIG. 5 is an isolated view of the utility boom component of the drilling rig of the invention.

FIG. 5 shows the utility swing arm 41 in greater detail. The swing arm 41 has opposing ends 50, 52 and an intermediate length. The end 50 pivots about a pivot point 54 located on the mud process skid 35. The length of the swing arm accommodates a number of different water and electrical lines, generally designated as 56 in FIG. 5. The swing arm 41 replaces the previous arrangement of utility lines running on the surrounding ground encased in rectangular boxes, moving the lines to an unobtrusive overhead location which improves the safety aspects of the arrangement and eliminates a danger of tripping over the lines. The pivot point 54 allows the swing arm to be pivoted, between the deployed position shown in FIG. 5, and a retracted or stowed position (not shown) aligned with the side of the mud skid for transport purposes. The opposing end of pivot point 54 also provides a "quick disconnect" point for the swing arm during rig mobilization activities. It can then be stored in the mud tank, if desired.

The mud pump skids 37, 39 accommodate either 1,000 hp or optional 1,300 hp triplex pumps and available Caterpillar™ engines, in this case the 3508 and 3512 engines. For example, the mud pumps can be Weatherford MP10™ or MP13™ pumps driven by variable speed diesel engines. The maximum rated working pressure for the mud pumps is 5,000 psi in the example illustrated. The transfer/mixing pumps used on the unit can be, for example, two 5"×6" W/50 H.P. Electric Motors™ mixing pumps having 11" impellers that are rated for 80 to 110 gallons per minute flow.

These pumps are used together with two charging pumps which can be 5"×6" MCM Pinion Shaft™ designs having an output capacity of 80 to 110 gallons per minute using 11" impellers. The mud process skid 33 and mud mixing skid 35 feature curved bottom tanks 36, 38 and together comprise a 700 barrel active, two tank system equipped with conventional shale shakers, a desander and a desilter (not shown).

The well blow-out preventer (best seen as 45 in FIG. 2) can be of conventional design such as, for example, the Townsend Type 90™ 11×5 M annular type; or the Townsend Type 82™ 11×5 M double ram which is used in conjunction with a M.D. Cowan 2-Rail BOP™ skid trolley.

Figure 6:
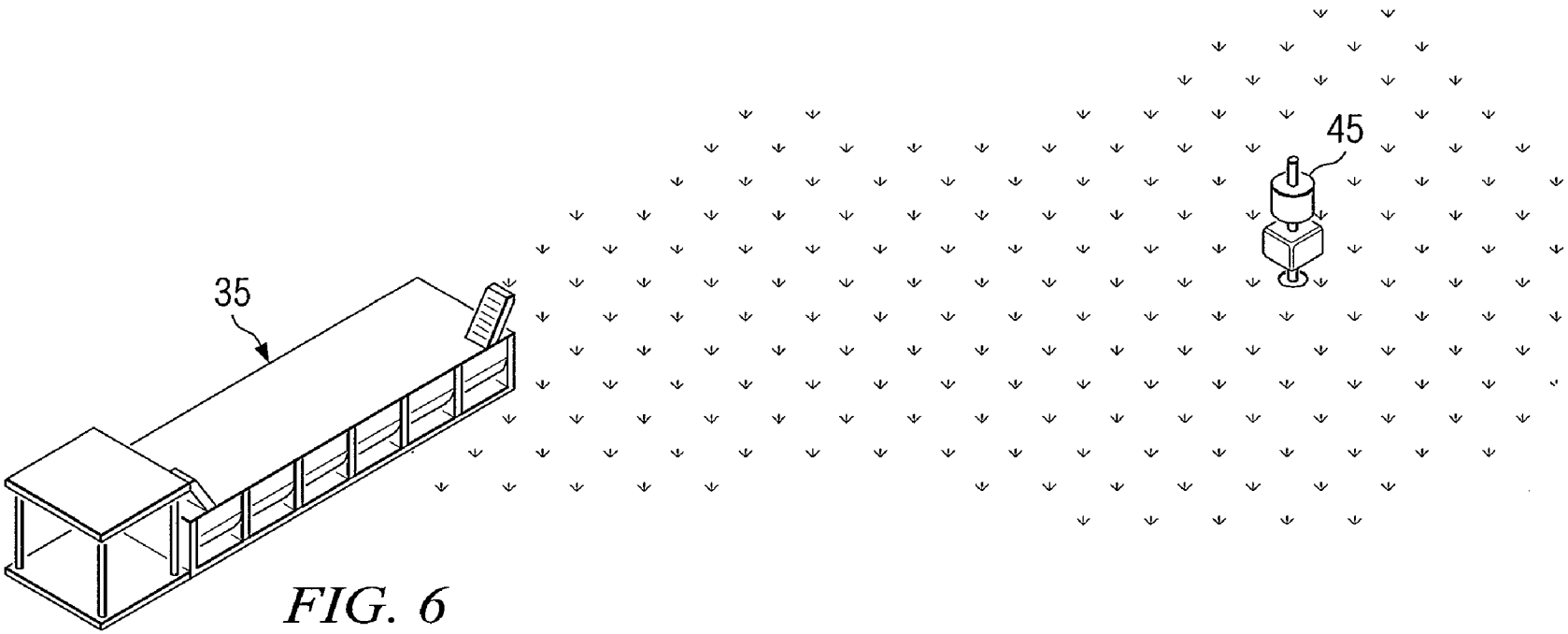
FIGS. 6-10 illustrate, in simplified fashion, the steps involved in assembling the base support structure and associated components of the drilling rig of FIG. 1.
Figure 7:
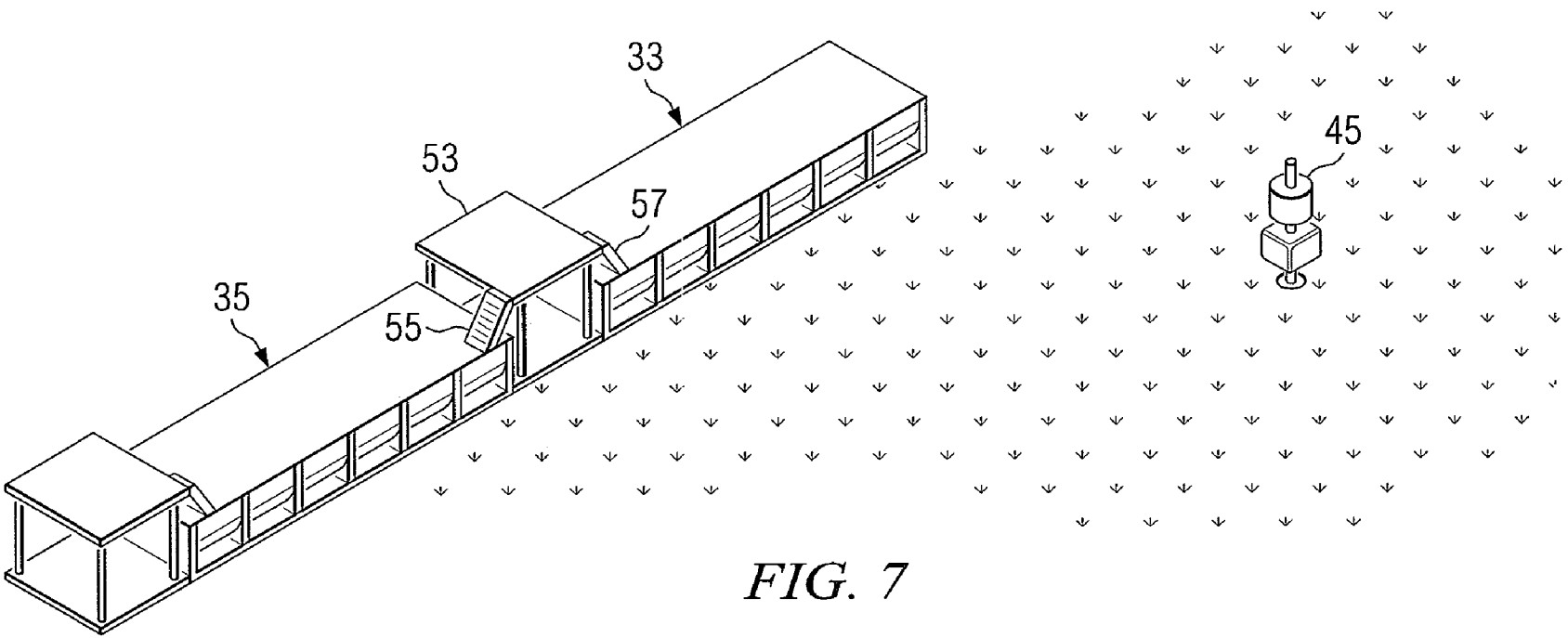
Figure 8:
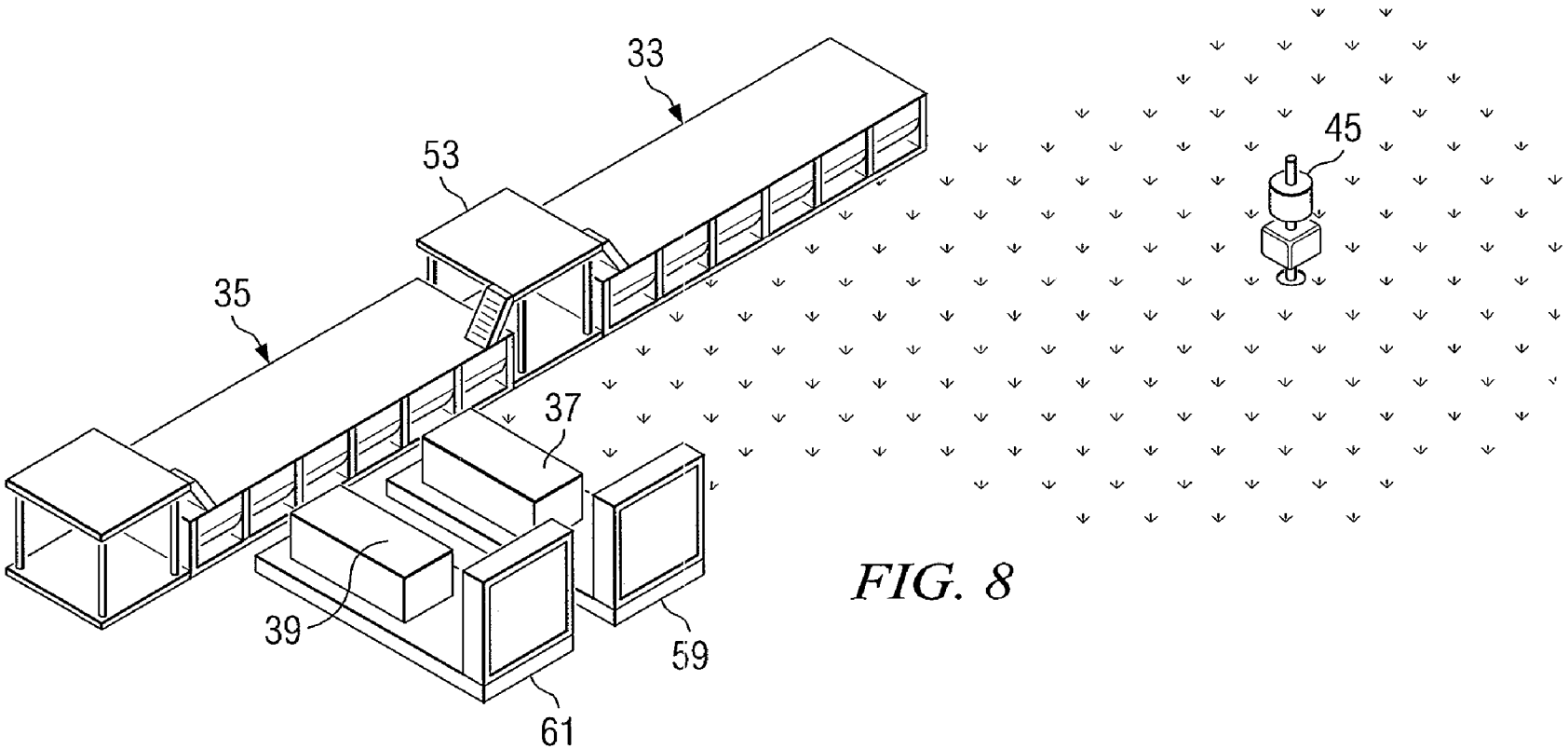

Turning now to FIG. 6 of the drawings, there is shown, in simplified fashion, the beginning step in the assembly of the mobile drilling rig of the invention. In FIG. 6, a semi-trailer rig has delivered and deposited the mixing skid for the process mud system. FIG. 7 shows the similar delivery of the process mud skid 33 which is aligned longitudinally with the mixing skid 35 and joined by an intermediate platform 53 and steps 55, 57. FIG. 8 shows the delivered mud pumps 37, 39, each being delivered on a skid 59, 61

Figure 9:
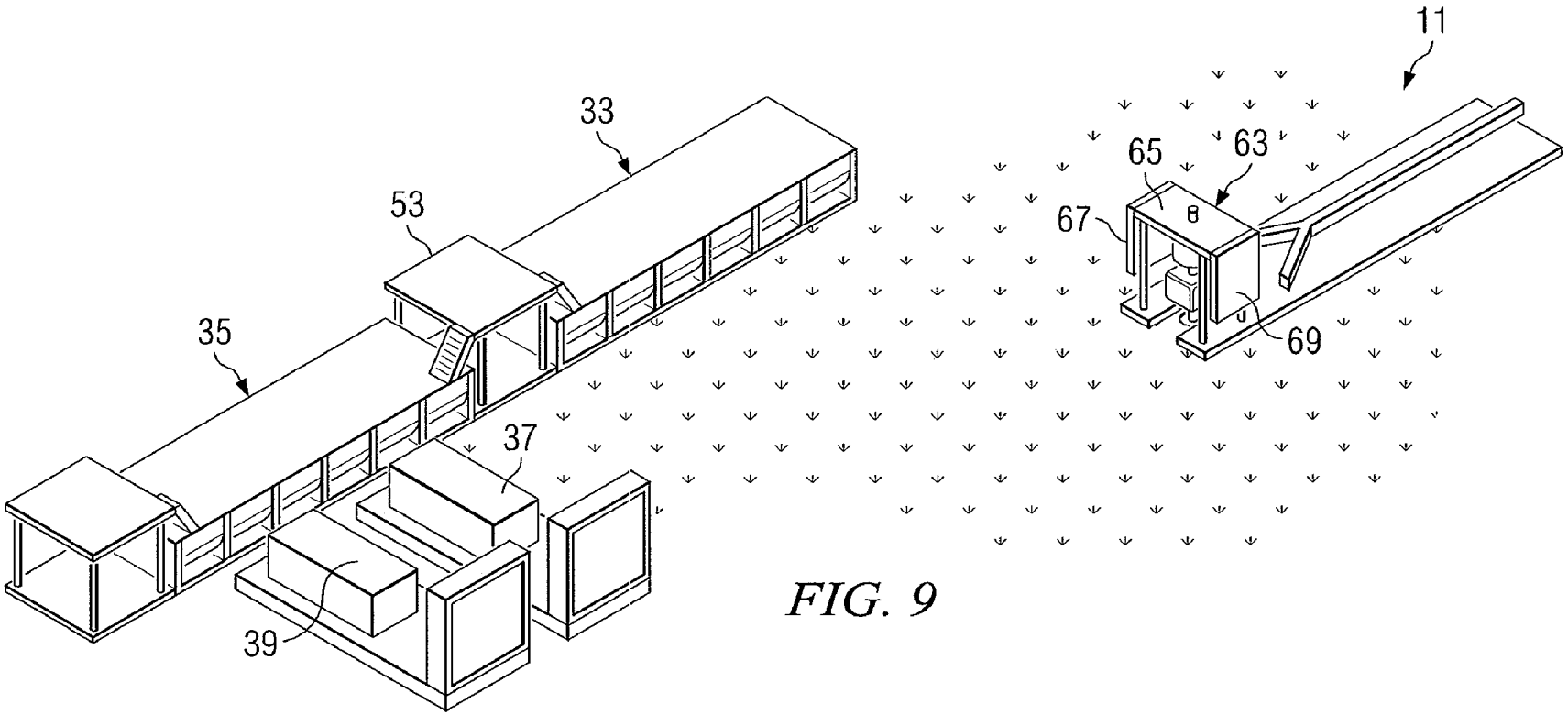
Figure 10:
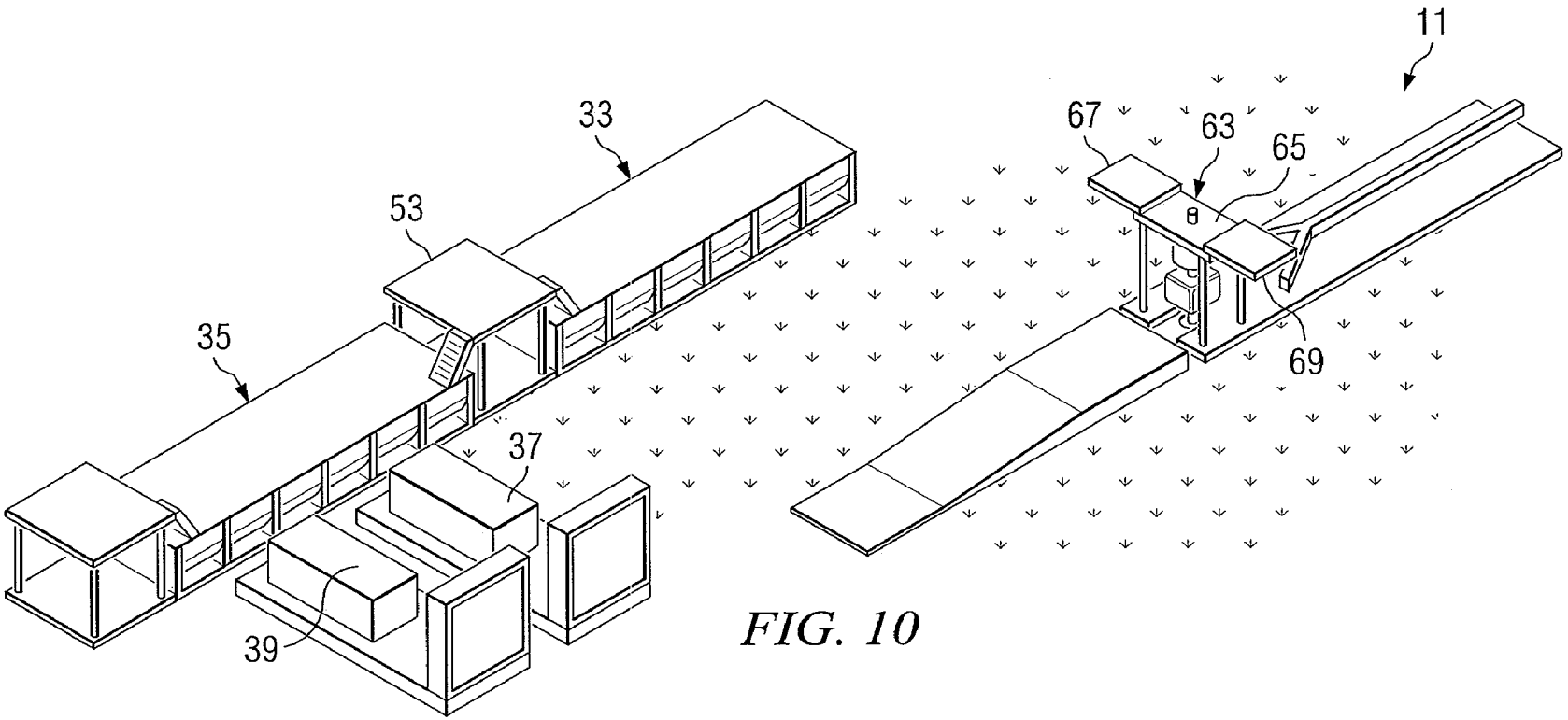

FIG. 9 shows the support base (designated generally as 63), drill floor 65 and oppositely arranged side extensions 67, 69. The pipe handler (shown in simplified fashion in FIG. 9) is also aligned with the well head and the support base and is positioned in a plane generally parallel to but spaced apart from the mixing skid 35 and process skid 33 of the mud system. FIG. 10 shows the side extensions 67, 69 raised to form a horizontal support surface on either side of the drill floor 65.

Figure 11:
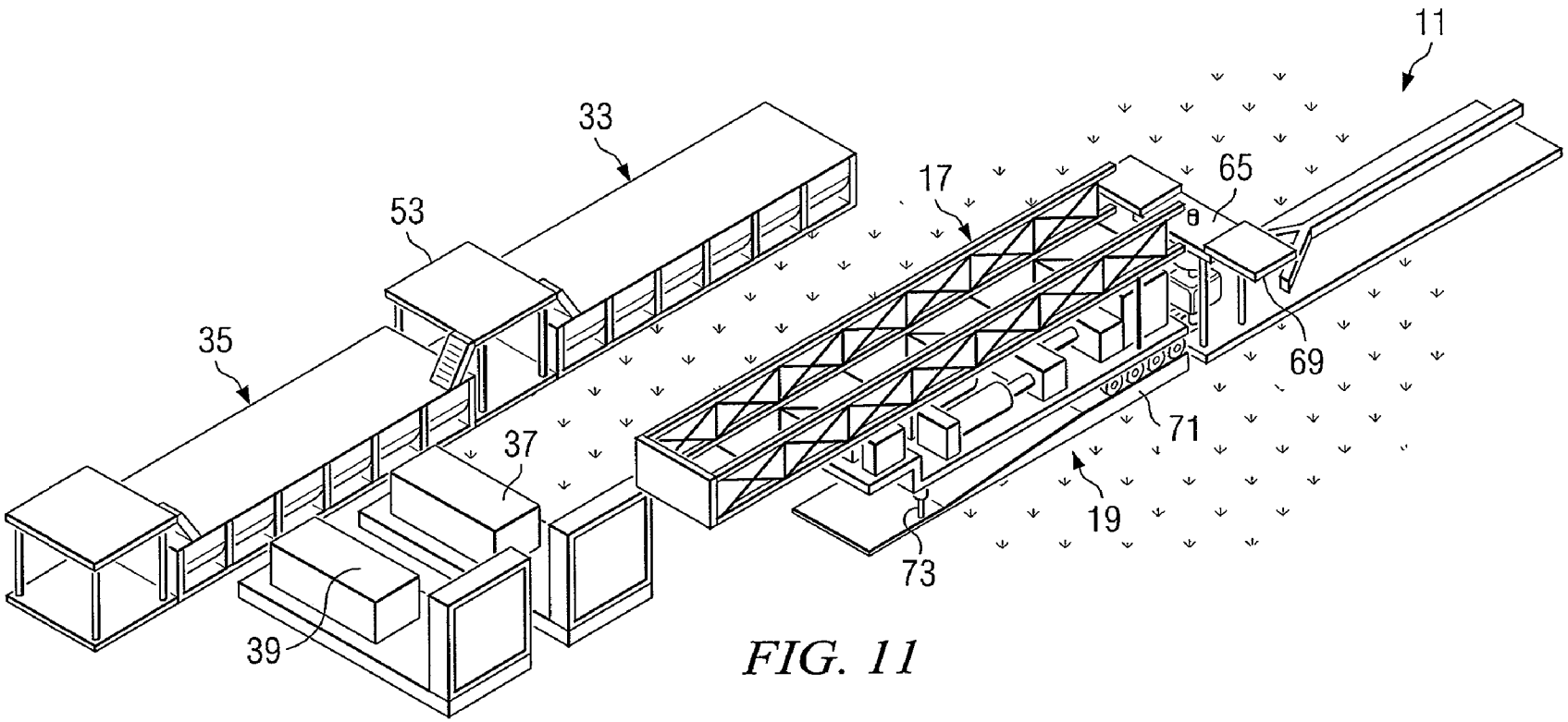
FIGS. 11-15 are a simplified, schematic representation of the steps involved in erecting the derrick mast structure, showing the loading of the derrick being transferred from the drawworks trailer to the base support substructure of the rig.
Figure 12:
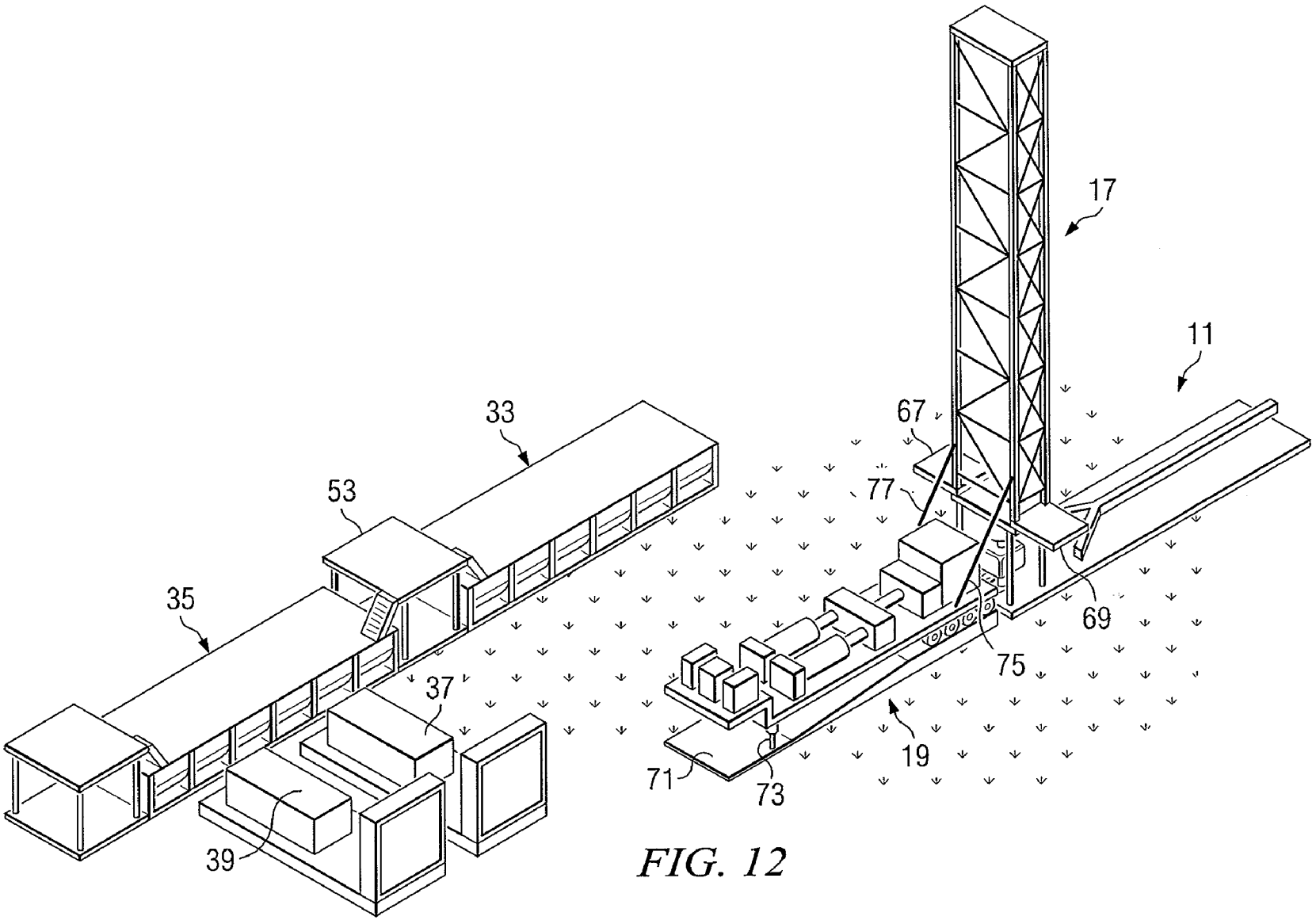

FIG. 11 shows the rig derrick 17 being delivered atop a drawworks trailer 19 The drawworks trailer is backed up a ramp substrate 71 to a point adjacent the support base 63. Once the drawworks trailer 19 is backed up the ramp substrate 71, the trailer cab is removed and the hydraulic legs 73 at the front end of the trailer 19 are actuated to level the front end of the trailer. With the drawworks trailer 19 in position, the rig derrick 17 can then be moved from the horizontal transport position shown in FIG. 11 to the vertical, working position shown in FIG. 12.

Figure 13:
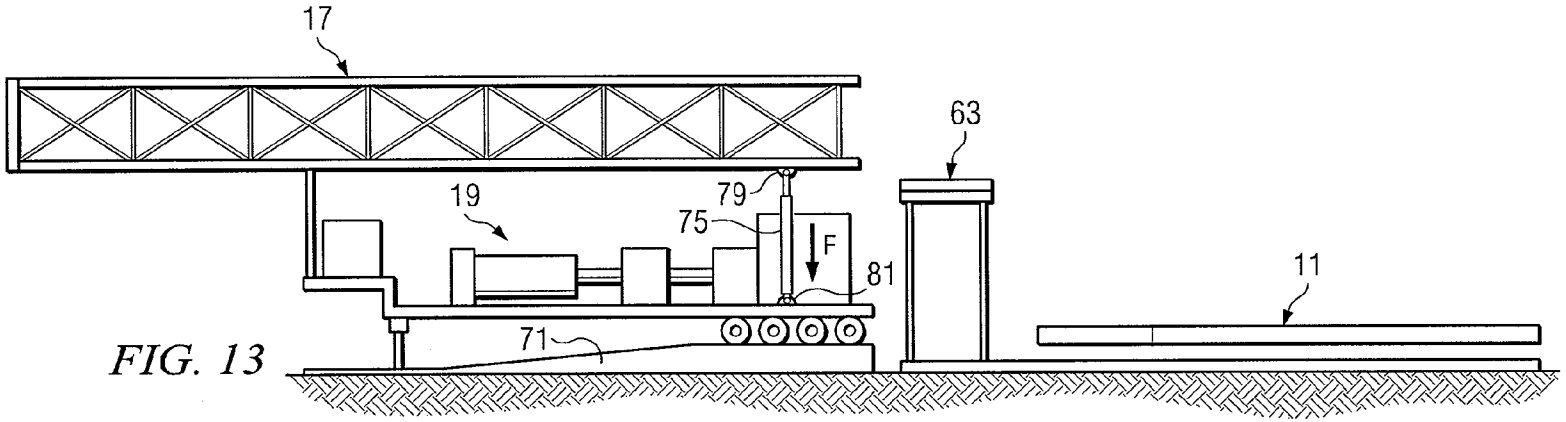
Figure 14:
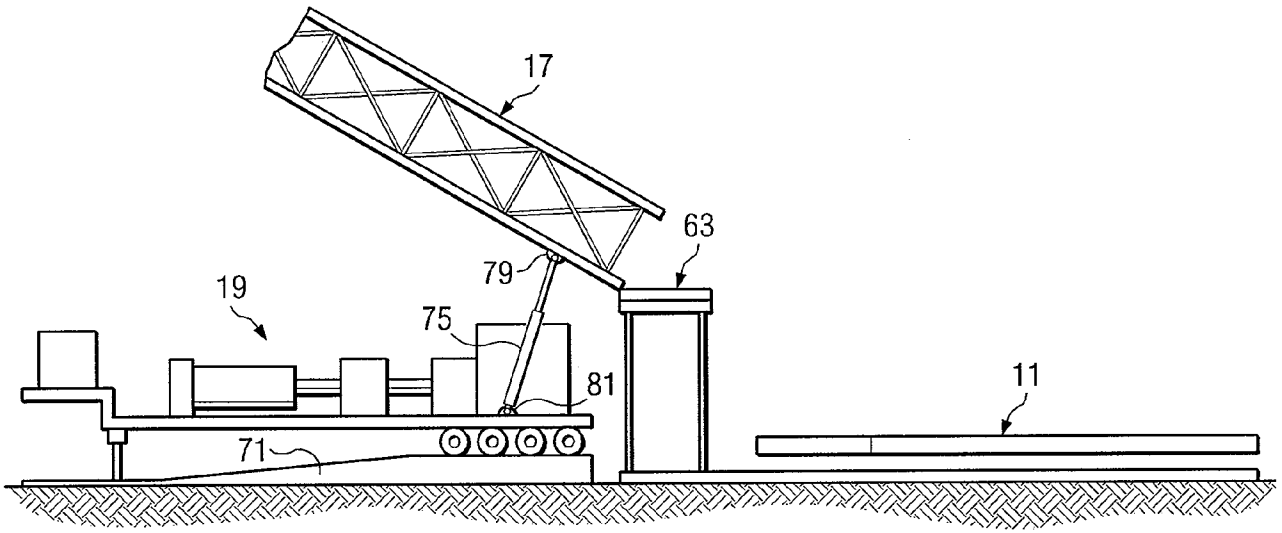
Figure 15:
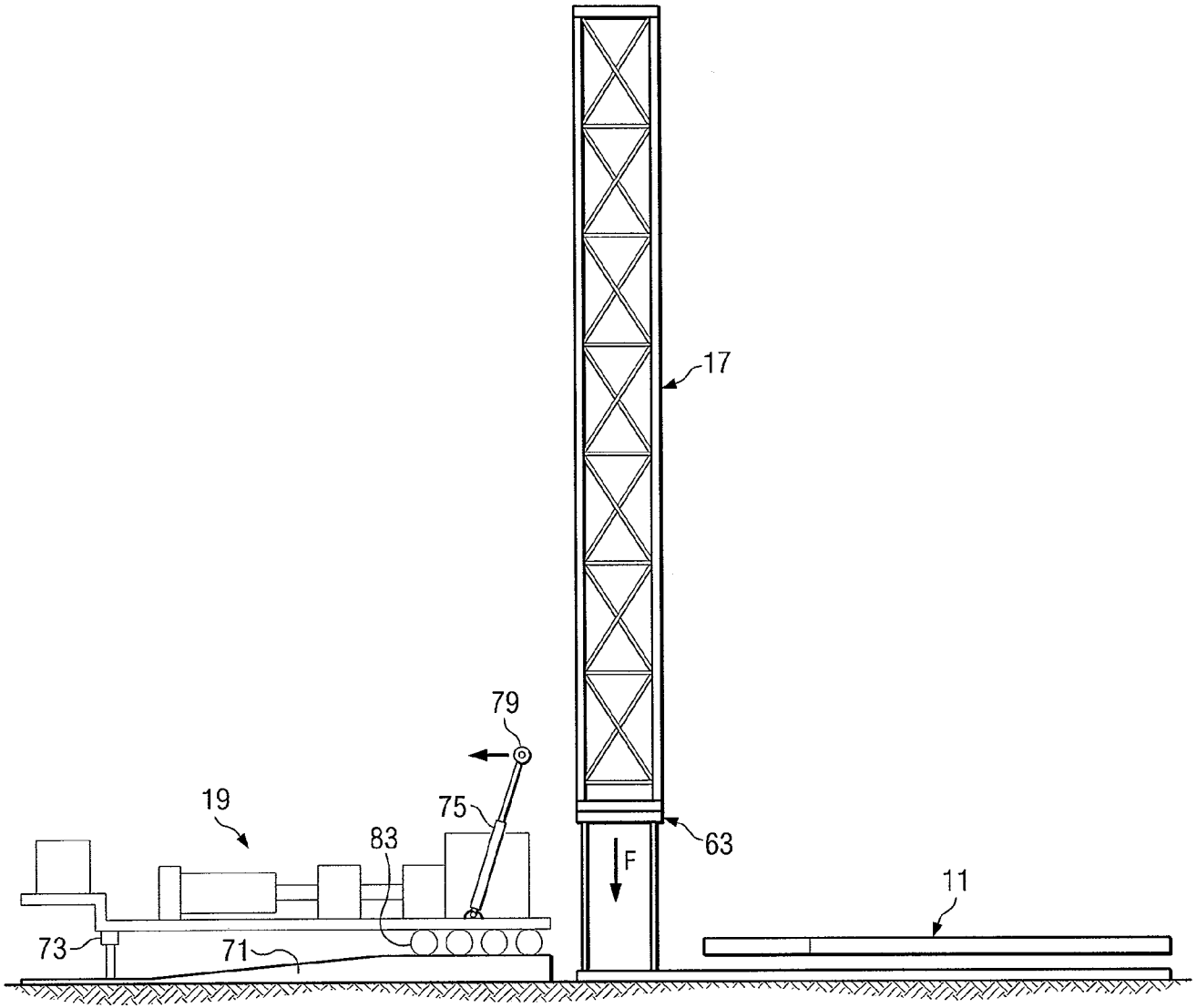

FIGS. 13-15 illustrate the off-loading of the rig derrick 17 from the drawworks trailer 19 in simplified, schematic fashion. As shown in FIG. 13, the derrick 17 is pivotally mounted on the drawworks trailer 19 by means of a pair of oppositely arranged hydraulic piston cylinders (75, 77 in FIG. 12). Each piston cylinder, e.g., cylinder 75 in FIG. 13 is attached at opposing pivot points 79, 81. Movement of each piston cylinder 75, 77 from the retracted position shown in FIG. 13 to the fully extended position (the intermediate position being shown in FIG. 15) causes the rig derrick 17 to be raised from the horizontal transport position to the vertical position shown in FIGS. 1 and 15. This movement of the hydraulic piston cylinders 75, 77 also causes the load of the derrick to be shifted off the drawworks trailer 19 and onto the support base substructure 63 of the drilling rig. While the hydraulic piston cylinders 75, 77 might not actually be physically detached, as shown in FIG. 15, this figure is intended to illustrate the point that the rig weight now resides on the support base 63, rather than upon the drawworks trailer 19, including its axles and tires 83. Note the force vector "F" in FIG. 15 showing the direction of the weight of the drilling rig once the derrick 17 is in the fully erect position.

Figure 16:
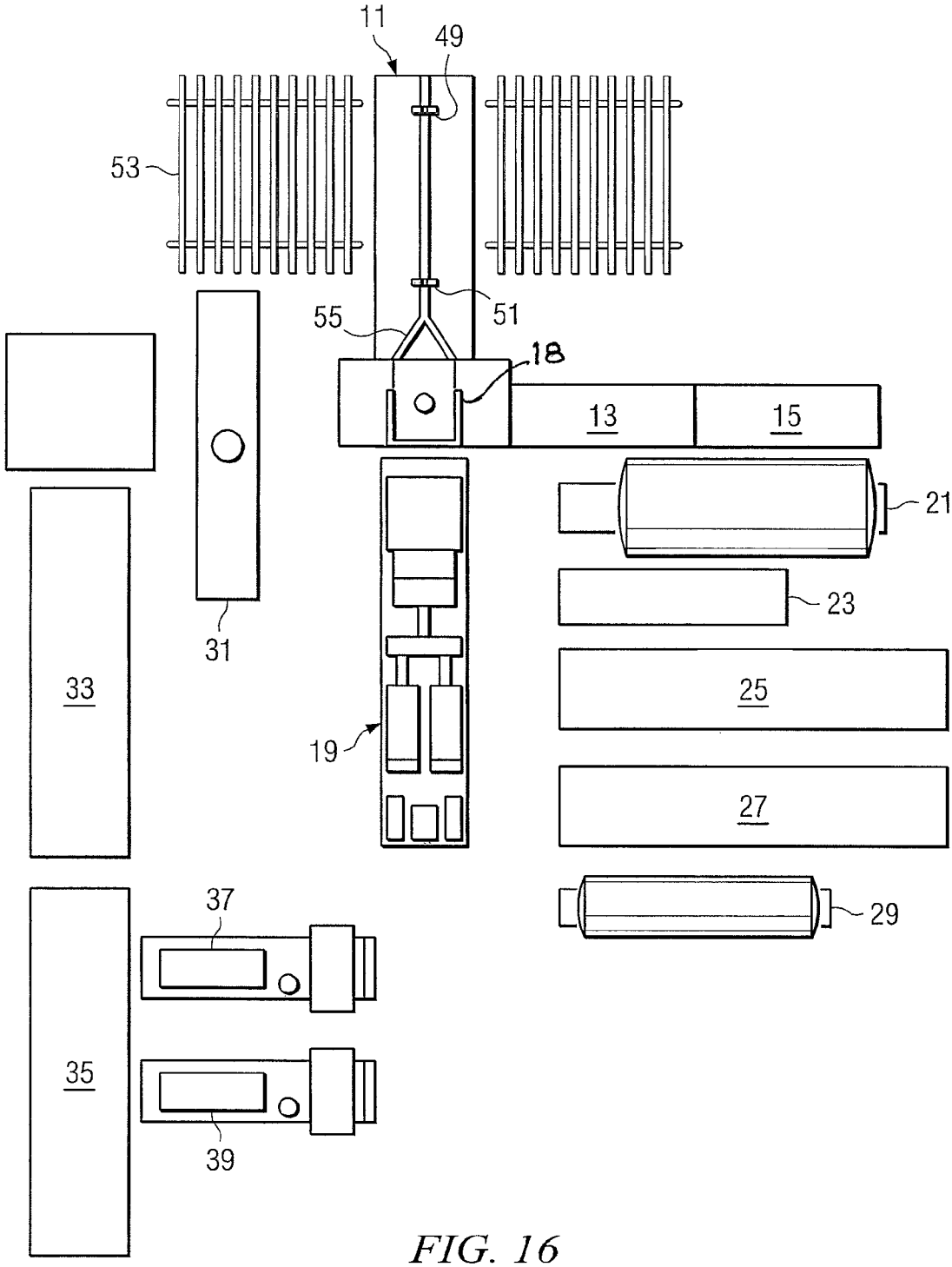
FIG. 16 is top view of the assembled drilling rig of the invention showing the various component parts thereof.

FIG. 16 is a top view of the fully assembly drilling rig showing the relative position of the various component parts of the rig.

Thus, the improved method for erecting, transporting and disassembling a drilling rig on the ground from variety of rig components includes, as a first step, rolling the drilling rig components into proximity with a drilling site on ground engaging wheels, where the drilling rig components include at least a base support structure, a drawworks trailer, a one-piece derrick initially carried on the drawworks trailer, a pipe handler, a mud delivery system and a power package. The one-piece derrick is raised from a horizontal, transport position to a vertical, working position while off-loading the derrick from the drawworks trailer to the base support structure. In the preferred method of assembly and disassembly of the invention, the drilling rig components are delivered and assembled without the use of cranes.

An invention has been provided with several advantages. As will be appreciated from the foregoing, the mobile rig of the invention is self sufficient in the sense that it is capable of being transported, erected, and disassembled without the need for large and extensive auxiliary equipment such as cranes. This results in a cost savings in eliminating the need for leasing cranes or other expensive erection equipment for periods of days during erection and disassembly of the rig. The rig is made up of components which are easily trailerable and transportable by tractor-trailer. As a result, the entire system can be easily moved from one site to another with a minimum of setup and takedown time. The drawworks trailer which initially transports the rig derrick is driven up a stationary ramp and leveled by means of hydraulic cylinders on the front end of the trailer. Another set of hydraulic piston-cylinders then moves the one-piece derrick from the horizontal, transport position to the vertical, working position where it is off-loaded onto the support base for the rig. This completely removes the vertical load from the drawworks trailer and places it on the more permanent and stationary support base of the rig.

While the invention has been shown in only one of its forms, it is not thus limited but is susceptible to various changes and modifications without departing from the spirit thereof.

What is claimed is:

1. A compact mobile drilling rig, comprising:

a one-piece drilling mast having an open side between first and second front mast rails, a base end, a top end, and configured for transport in one piece on a single drawworks trailer;

a single drawworks trailer for transporting said one-piece drilling mast in a horizontal position thereon;

a mechanism fixed to said single drawworks trailer and detachably coupled to said one-piece drilling mast for erecting said mast without the use of a crane to a vertical, free-standing position entirely supported upon said base end of said mast, wherein said mechanism for erecting is detachable from said one-piece drilling mast following said erecting;

a support base for said one-piece drilling mast;

a pipe-handling boom having a yoke for pivotally attaching said boom to a lower portion of said support base, for pivoting said boom from a horizontal pipe loading position upward to a vertical pipe connecting position in line with a well bore being drilled in a single operation to insert sections of said pipe into a drill string bisecting a straight line between and passing through said first and second front mast rails on line;

a pivoting adjunct boom section attached to and parallel to said pipe-handling boom configured to pivot the pipe section in a horizontal plane and having at least first and second gripping jaws attached to said pivoting adjunct boom section and configured for grasping and supporting a section of pipe for handling by said pipe handling boom; and a traveling crown block having first and second extended length bat wing supports and an integrated top drive, said crown block configured for vertical movement along said open side between said first and second front rails of said one-piece drilling mast while supporting said drill string bisecting a straight line disposed at right angles between said first and second rails during drilling and assembly and disassembly of said drill string.

2. The compact mobile drilling rig of claim 1, wherein said traveling crown block integrated with said top drive further comprises:

a plurality of sheaves oriented vertically; and a frame comprising said first and second bat wing supports for supporting said plurality of sheaves and said top drive in an integrated unit configured for said vertical movement along said first and second front rails of said one-piece drilling mast.

3. The compact mobile drilling rig of claim 2, wherein:

said frame is extended in a vertical direction for stabilizing said vertical movement of said top drive along said first and second front rails of said one-piece drilling mast.

4. The compact mobile drilling rig of claim 1, further comprising:

at least first and second hydraulic cylinders coupled between said pipe-handling boom and said pivoting adjunct boom section for causing said pivoting of said pivoting adjunct boom section.

* * * * *